US006312054B1

(12) United States Patent
Scheurer et al.

(10) Patent No.: US 6,312,054 B1
(45) Date of Patent: Nov. 6, 2001

(54) BUOYANT POOL CHAIR WITH ADJUSTABLE ANGLE OF RECLINE

(75) Inventors: Robert S. Scheurer; Michael L. Perry, both of Wichita Falls, TX (US)

(73) Assignee: Texas Recreation Corporation, Wichita Falls, TX (US)

( * ) Notice: Subject to any disclaimer, the term of this patent is extended or adjusted under 35 U.S.C. 154(b) by 0 days.

(21) Appl. No.: 09/447,173

(22) Filed: Nov. 22, 1999

Related U.S. Application Data

(63) Continuation-in-part of application No. 09/178,818, filed on Oct. 26, 1998, now Pat. No. 6,086,150.

(51) Int. Cl.[7] ..... B60N 2/02; A47C 1/02

(52) U.S. Cl. ..... 297/373; 297/219.1; 297/452.17; 297/452.19; 441/129; 441/130

(58) Field of Search ..... 297/363, 373, 297/219.1, 452.17, 452.19, 378.1; 441/129, 126, 127, 130, 132; 4/496; 114/363

(56) References Cited

U.S. PATENT DOCUMENTS

| | | | | |
|---|---|---|---|---|
| 3,074,759 | | 1/1963 | Bergenwall . | |
| 3,154,345 | | 10/1964 | Lambrecht . | |
| 3,620,570 | | 11/1971 | Wilson . | |
| 3,984,888 | * | 10/1976 | DeLano | 297/363 |
| 4,026,567 | | 5/1977 | Rye . | |
| 4,358,866 | | 11/1982 | Rhodes . | |
| 4,384,857 | | 5/1983 | Hoy, Jr. | 441/130 |
| 4,435,165 | | 3/1984 | Johnson | 441/130 |
| 4,484,781 | | 11/1984 | Phelps . | |
| 4,662,852 | | 5/1987 | Schneider et al. | 441/132 |
| 4,884,840 | | 12/1989 | Linden et al. . | |
| 5,004,296 | | 4/1991 | Ziegenfuss, Jr. . | |
| 5,052,965 | | 10/1991 | Klapp et al. | 441/130 |
| 5,088,723 | | 2/1992 | Simmons . | |
| 5,226,184 | | 7/1993 | Cheng . | |
| 5,307,527 | | 5/1994 | Schober | 4/496 |
| 5,403,220 | | 4/1995 | Goad, Sr. | 441/130 |
| 5,439,405 | * | 8/1995 | Storey et al. | 441/127 |
| 6,045,423 | * | 4/2000 | Silvia | 441/130 |

* cited by examiner

*Primary Examiner*—Anthony D. Barfield
(74) *Attorney, Agent, or Firm*—Dennis T. Griggs

(57) ABSTRACT

A buoyant lounge chair supports a swimmer in an upright, semi-reclining or fully reclining position while the chair is floating in a swimming pool. Interconnected rigid frame members collectively form an open chair frame including a seat frame, left and right arm frames attached to the seat frame, and a back frame pivotally coupled to the seat frame. The back frame is pivotally coupled to the seat frame on opposite sides by dual axle shafts. A manually operable clutch is mounted on each axle shaft for releasably connecting the seat frame to the back frame. Each clutch is manually releasable to permit pivotal movement of the back frame relative to the seat frame, and is manually engagable to fix the angle of recline of the back frame with respect to the seat frame.

30 Claims, 13 Drawing Sheets

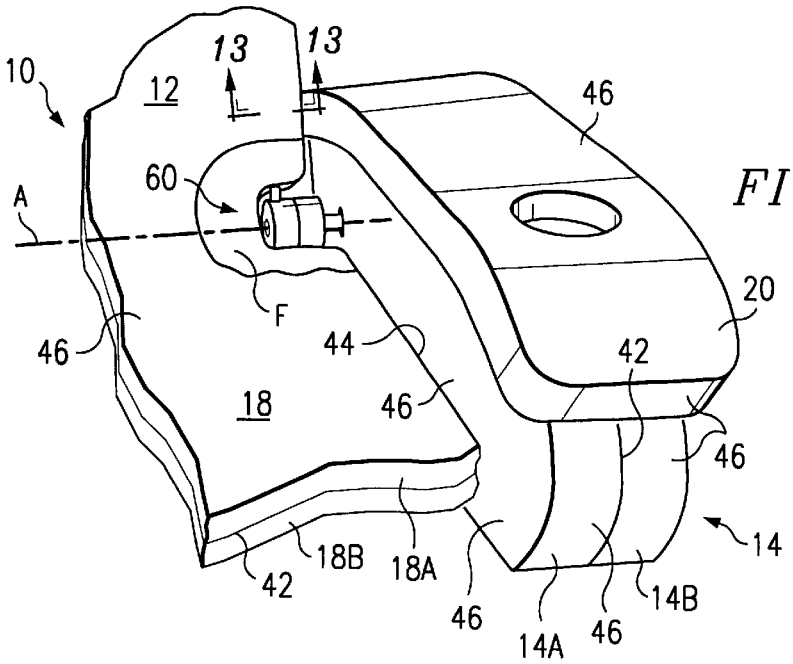
FIG. 12
FIG. 13
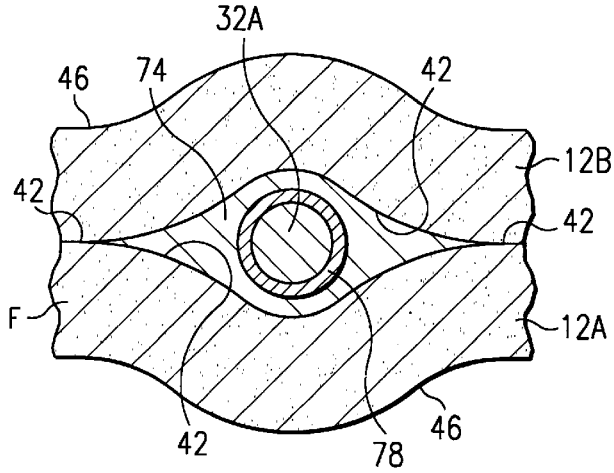
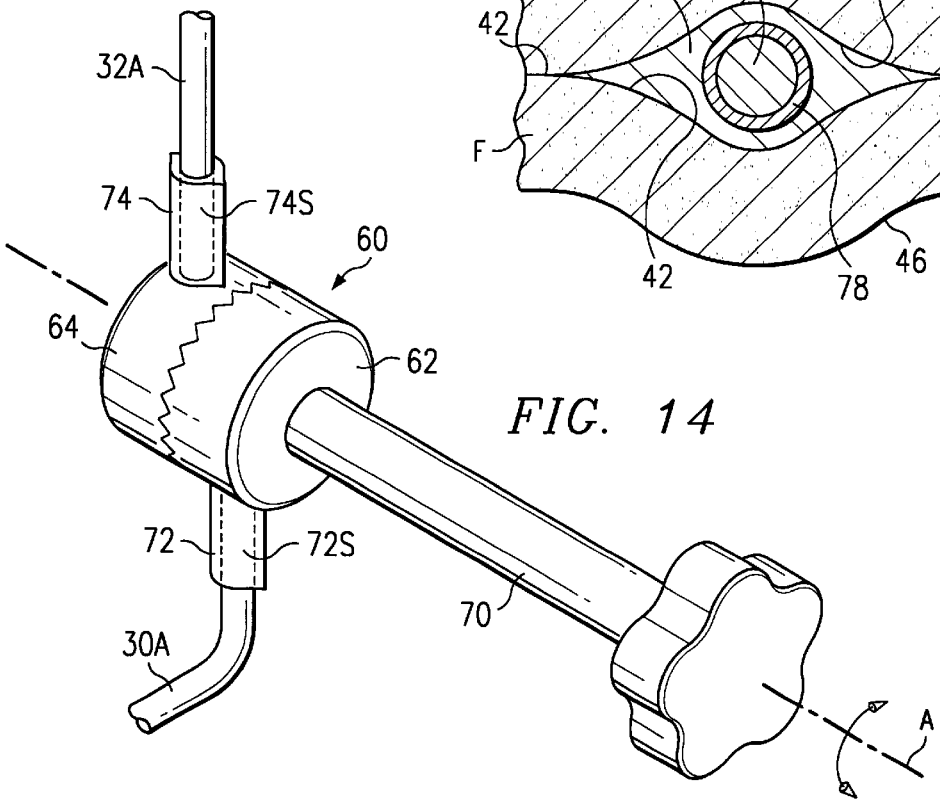
FIG. 14

BUOYANT POOL CHAIR WITH ADJUSTABLE ANGLE OF RECLINE

CROSS-REFERENCE TO RELATED APPLICATIONS

This application is a continuation-in-part of application Ser. No. 09/178,818 filed Oct. 26, 1998 now U.S. Pat. No. 6,086,150.

BACKGROUND OF THE INVENTION

This invention relates generally to swimming pool accessories, and in particular to a buoyant lounge chair having an adjustable back for supporting a person in a semi-reclining position while the chair is floating in water, and also adjustable to a fully reclined, lounging position for use as a body float.

Swimming pools offer personal recreation and relaxation in a variety of settings, for example in private homes, apartment complexes, motels, resorts and country clubs. Various flotation devices including buoyant chairs, rafts, water wings, floating cushions, body floats and air mattresses are used by swimmers as an aid for floating and relaxing on the surface of the water, while remaining seated upright, reclining or lounging, either partially or completely submerged. These items of pool furniture include flotation cushions made of a buoyant material such as open cell foam, closed cell foam, cork, kapok, fiberglass or balsa wood, which are sealed within a protective outer covering.

A popular item of pool furniture is the buoyant lounge chair which permits a swimmer to relax on the surface of the water in a seated, semi-reclining orientation. In some lounge chair designs, the angle of recline is fixed and determined by the form of the rigid frame on which buoyancy cushions are attached, for example as shown in our co-pending application Ser. No. 09/178,818 filed Oct. 26, 1998, now U.S. Pat. No. 6,086,150, which is incorporated herein by reference. That buoyant lounge chair, manufactured and sold by Texas Recreation Corporation of Wichita Falls, Tex. has met with considerable commercial success. The present invention was stimulated by the need for a buoyant lounge chair having an adjustable seat back which can be manually set through a range of recline angle positions from fully extended, in which the pool chair functions essentially as a buoyant mattress or body float, to a fully folded, minimum profile configuration for storage purposes, and to facilitate handling and shipment. To accommodate personal preferences and a wide range of body sizes, the back rest should be easily adjusted and set at various angles of recline, including the standard angle of recline provided by conventional fixed-back lounge chairs.

According to one conventional buoyant lounge chair arrangement, as shown in U.S. Pat. No. 4,662,852, the back rest frame is pivotally connected to the seat frame and is inclined against a rear cross bar, and the seat frame is braced by releasable engagement of a slotted bracket with a forward cross bar. The angle of recline is adjusted by extending and retracting the slotted bracket relative to the forward cross bar. This movement translates into angle of recline adjustment as the two sections pivot about a common hinge axis.

An important consideration in the design and construction of buoyant lounge chairs, including those in which the angle of incline is adjustable, is the maintenance of a water-tight seal about the cushion material and around the welded metal frame. The interlocking components of the adjustable coupling apparatus should also be covered, and at the same time should be readily accessible and easy to manipulate by the swimmer when he or she is seated in the upright lounging position.

The external surface of the lounge chair is susceptible to attack by mildew, fungus, surface hardening, cracking and shrinking which are caused by long-term exposure to water, pool chemicals and solar radiation. Consequently, lounge chairs as well as other buoyant flotation devices are desirably protected by a durable, non-reactive coating of plastic material, such as vinyl. The protective coating must be soft, pliable and able to withstand rough handling and high shear forces along the joinder lines between the chair arms, the chair seat, and along the flex lines between the chair back and chair seat. The protective coating is applied by various processes, including dipping and spraying, preferably as set forth in our co-pending Application Ser. No. 09/178,818 filed Oct. 26, 1998, incorporated herein by reference.

Another limitation imposed by the construction of conventional lounge chairs is that the buoyant arm support sections are subject to tearing or deformation, and are also subject to collapse and separation from the chair frame at the interface between the arm support sections and the chair seat.

Special care should be taken in the construction of buoyant lounge chairs to provide sufficient buoyancy material to maintain a stable upright orientation while the occupant is in a reclining or lounging position. The buoyant lounge chair can overturn in response to shifting of its center of buoyancy as the occupant moves about while in a reclining or partially reclining orientation.

SUMMARY OF THE INVENTION

The buoyant lounge chair of the present invention provides stable support for a swimmer in an upright, semi-reclining or fully reclined, lounging position while the chair is floating in a swimming pool. Interconnected rigid frame members collectively form an open chair frame. In the preferred embodiment, the frame members include a seat frame, left and right side arm frames attached to the seat frame, and a movable back frame. The back frame is pivotally coupled to the seat frame on opposite sides by dual axle shafts. A manually operable clutch is mounted on each axle shaft for releasably connecting the seat frame to the back frame. Each clutch is manually releasable to permit pivotal movement of the back frame relative to the seat frame, and is manually engagable to fix the angle of recline of the back frame to the seat frame.

Buoyant cushions are attached to the frame members, thereby forming a chair seat, a chair back, left and right chair arms and a bolster block. The buoyant cushions forming the chair seat, the chair arms, the chair back and the bolster block each include layers of buoyant cushion material secured and sealed together by an adhesive deposit in overlapping relation, with each chair frame member being enclosed and sealed between a pair of buoyant layers. Each axle shaft and clutch are also enclosed between a pair of the buoyant layers. Each clutch includes a manual actuator which extends laterally through a passage formed in a pair of buoyant arm cushions, and projects externally of each chair arm at a side location in which it can be conveniently manipulated for engaging and releasing the clutch while the operator is seated or reclining on the lounge chair.

Each buoyant arm support section is reinforced by an upright arm support riser that is laterally offset from the seat frame and by a horizontal arm rest segment that is vertically offset from the seat frame. The left and right buoyant chair arms are stabilized and reinforced against collapse and separation from the chair frame by the upright arm support risers and the horizontal arm rest segments that are sandwiched between the buoyant arm support cushions.

In the preferred embodiment, the left and right arm support cushions project aft of the pivotal union between the chair seat the chair back. According to this arrangement, the aft projecting portions of the arm support cushions overlap the laterally opposite end portions of the bolster block. The arm support cushions are reinforced against deflection and separation from the chair frame by an aft extension bar attached to the arm rest frame. The extension bar is laterally offset from the seat frame and from the back frame, and projects aft of the pivotal clutch union. The buoyant arm support cushions are further reinforced and stabilized against vertical deflection by the clutch actuator which extends laterally through the buoyant arm cushions.

According to another aspect of the invention, the upright floating stability of the lounge chair is improved by extension portions of the buoyant arm cushions which project aft of the chair seat, substantially overlapping the opposite end portions of the bolster block. The upright floating stability of the lounge chair is also improved by a seat frame assembly including left and right seat frame segments each including an angled connecting portion attached to a central seat frame segment. The angled connecting portions slope downwardly relative to the seat frame segments, whereby the buoyant cushions in combination with the seat frame segments form a leg support section that slopes downwardly relative to the chair seat and buoyant arm cushions.

The floating stability of the lounge chair is further improved by buoyant arm rest cushions which are mounted on top of the left arm and right arm support cushions. The arm rest cushions extend aft of the seat frame/back frame pivotal clutch union, substantially in flush alignment with the bolster block when the seat back is set in the upright lounging position.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

FIG. 12 is a perspective view of the buoyant lounge chair shown in FIG. 1, partially broken away, showing details of the pivotal coupling and clutch assembly which connect the foldable back frame to the seat frame;

FIG. 13 is a sectional view, partially broken away, taken along the line 13—13 of FIG. 1 showing abutting cushion layers that are adhesively sealed together around a portion of the back frame;

FIG. 14 is a perspective view, partially broken away, of the pivotal coupling and clutch assembly shown in FIG. 12;

DETAILED DESCRIPTION OF THE INVENTION

Figure 1:
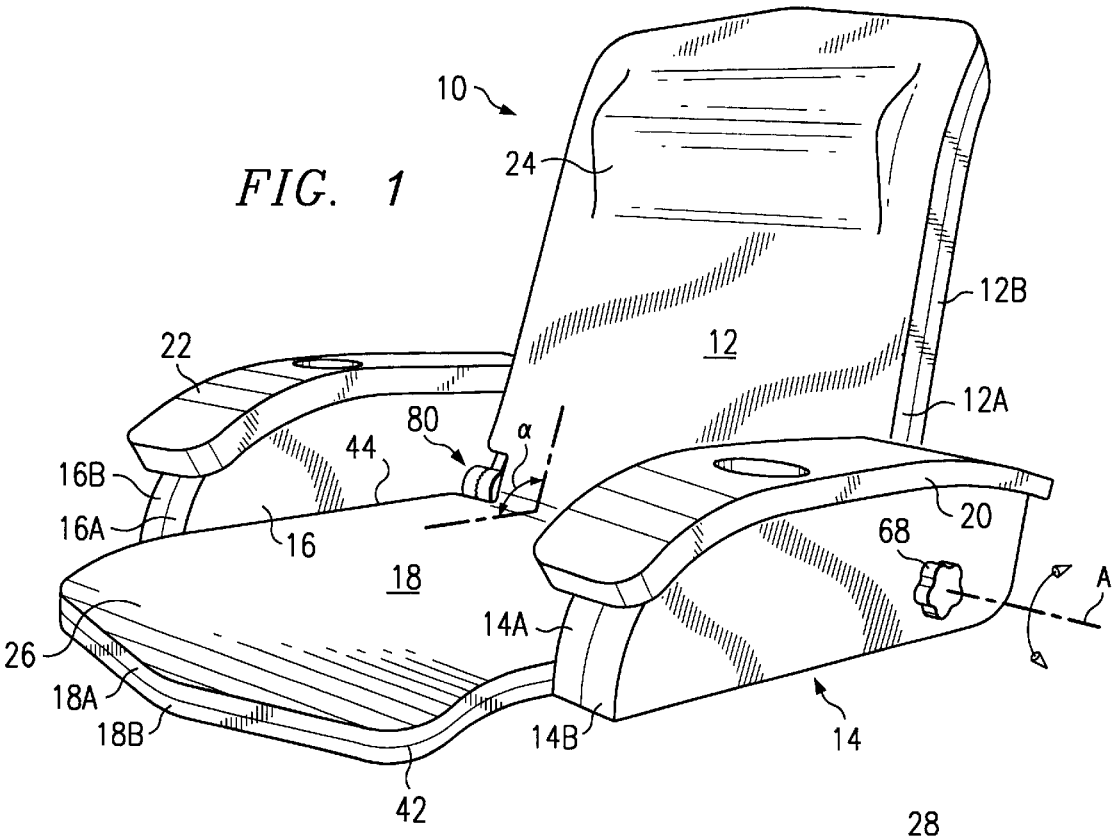
FIG. 1 is perspective view of a buoyant lounge chair constructed according to the preferred embodiment of the present invention.

Preferred embodiments of the invention will now be described with reference to various examples of how the invention can best be made and used. Like reference numerals are used throughout the description and several views of the drawing to indicate like or corresponding parts.

Referring now to FIG. 1 –FIG. 7, there is illustrated an exemplary embodiment of a light-weight buoyant lounge chair 10 for selectively supporting a person in seated, semi-reclining and fully reclining lounge positions while the chair is floating in water. The lounge chair 10 includes an adjustable chair back 12, chair arms 14, 16, a chair seat 18 and arm rest cushions 20, 22 which provide full body support in the seated, upright, semi-reclining, reclining and fully reclining lounge positions.

The operative upright floating position refers to the flotation orientation of the lounge chair 10 with the chair back 12 and chair arms 14, 16 generally upright while the chair seat 18 is generally horizontal and at least partially submerged as indicated in FIG. 1. When the lounge chair is floating in water, the occupant is supported in a comfortable lounging orientation, with his arms being supported by the left arm rest cushion 20, the right arm rest cushion 22 and his head is supported by a head support cushion 24. The occupant's legs are supported by a leg support section 26 which projects forwardly from the chair seat 18.

Figure 2:
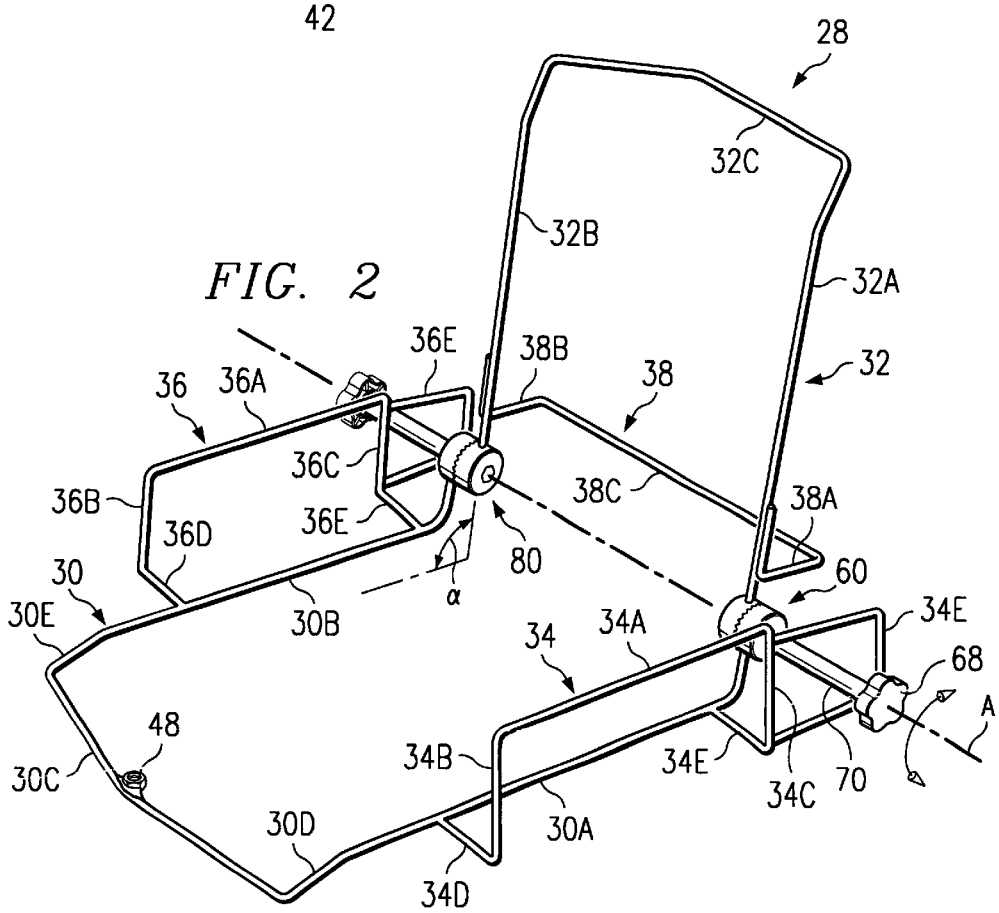
FIG. 2 is a perspective view thereof showing interconnected rigid frame members including a pivotally coupled back frame collectively forming an open chair frame.
Figure 3:
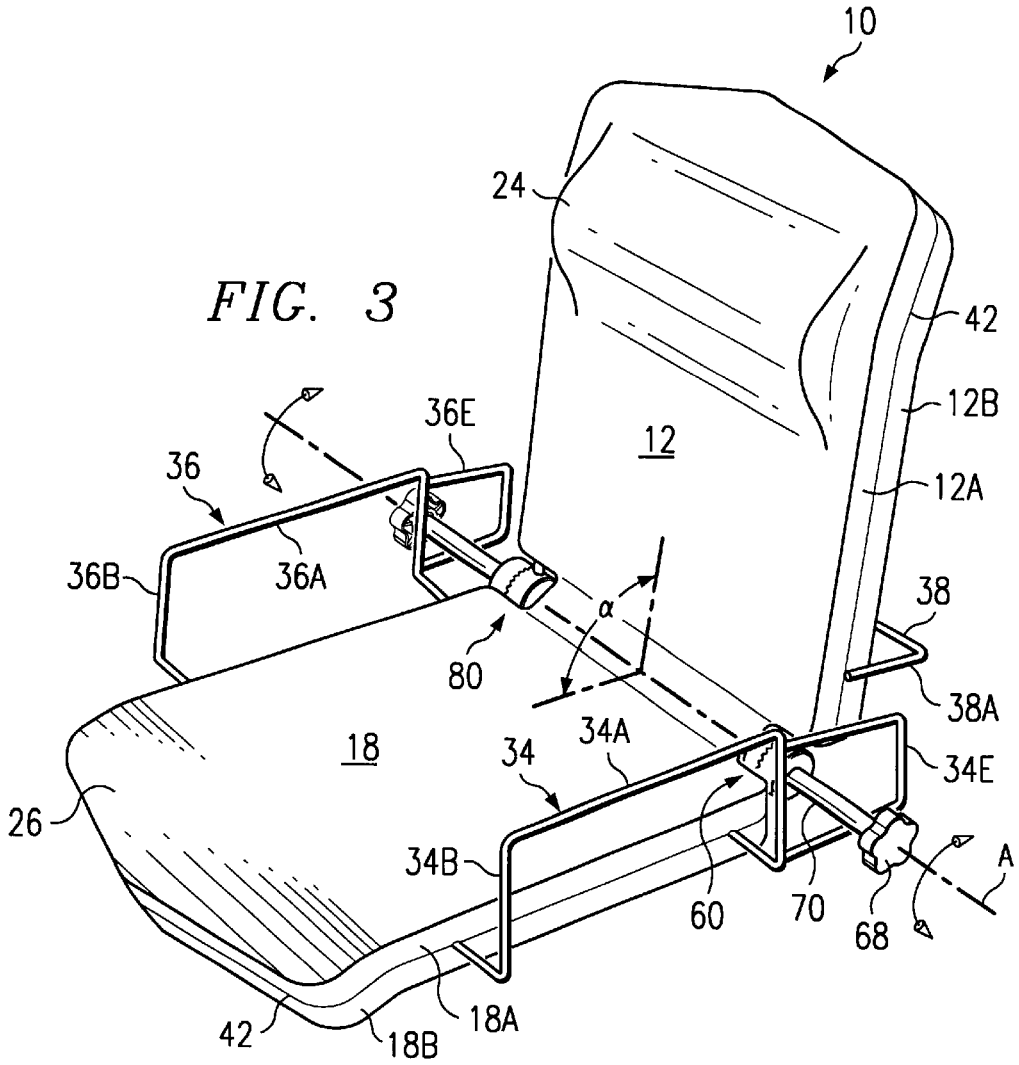
FIG. 3 is a perspective view showing first and second layers of buoyant cushion material secured together in overlapping relation, with the seat frame and back frame of the chair being sandwiched between the buoyant layers, the top layer forming a continuous body support surface that transitions through the pivotal union between the seat frame and the back frame.
Figure 4:
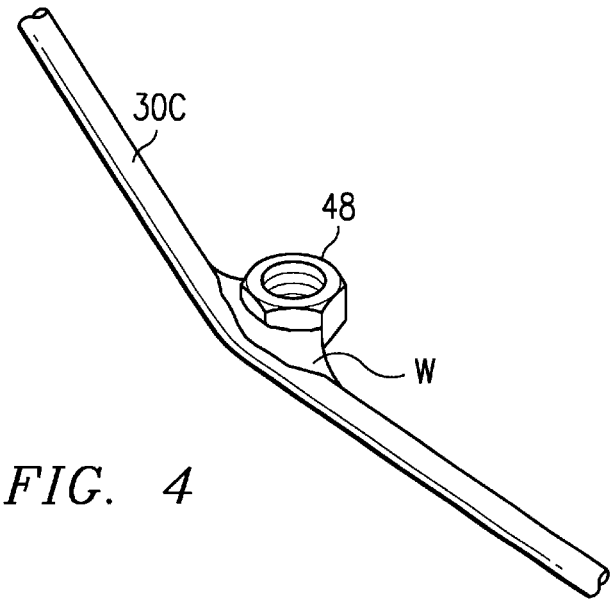
FIG. 4 is a perspective view of a portion of the seat frame, showing a threaded coupling nut welded onto a central seat frame segment.
Figure 10:
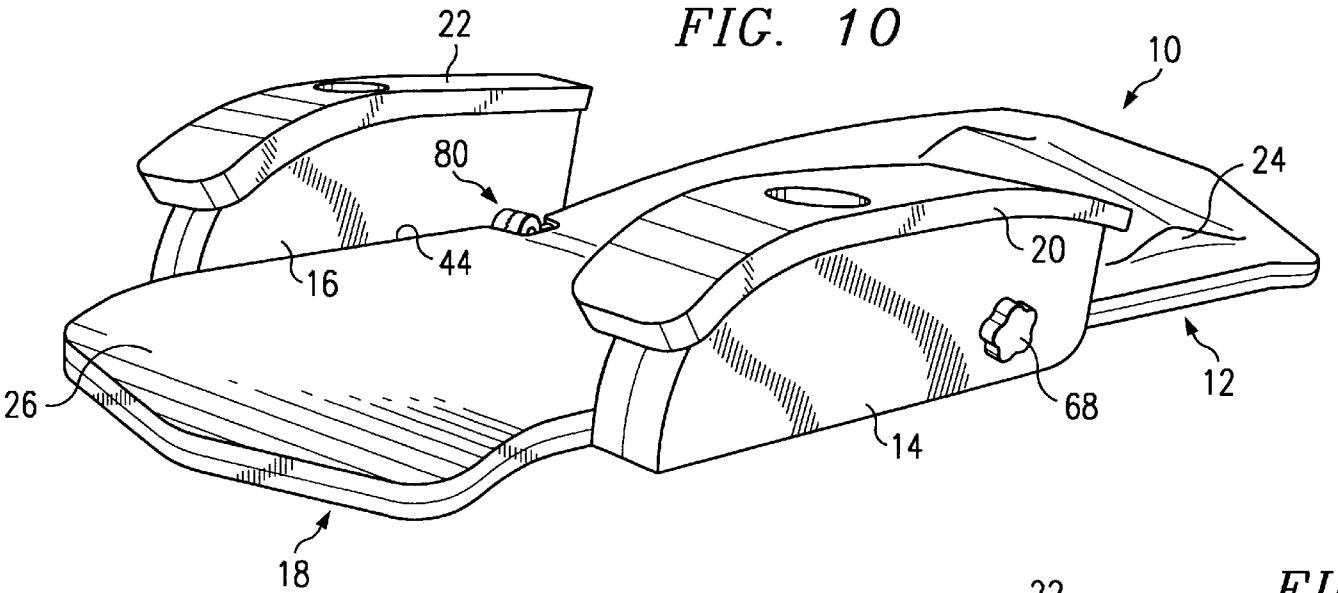
FIG. 10 is a perspective view of the fully assembled buoyant lounge chair of FIG. 1 with the back unfolded to he fully reclining (body float) position.

Buoyancy sufficient to support an adult occupant having a body weight up to 250 lbs. is provided by multiple pairs of overlapping buoyant cushions that are attached to an open chair frame 28 shown in FIG. 2. The open chair frame 28 is a skeleton frame formed by interconnected rigid frame members, preferably 5/16 inch diameter steel rod segments that are welded together. The rigid steel rod segments form a seat frame 30, a back frame 32 that is pivotally coupled to the seat frame along a pivotal axis A and is adjustable through an incline angle , which ranges from about 10° in the folded configuration (FIG. 11) to about 180° in the fully extended, body float configuration (FIG. 10). A left arm frame 34 and a right arm frame 36 are attached to the seat frame but are separated from the back frame to permit free movement of the back frame during adjustment of the recline angle . A bolster frame 38 is welded onto the back frame 32, projecting aft of the chair frame and extending laterally substantially from the left side to the right side of the chair frame 28.

Buoyant cushions formed by overlapping layers of buoyant cushion material are attached to the individual steel rod frame segments, thereby forming the buoyant chair back 12, the left chair arm 14, the right chair arm 16, the chair seat 18 and a bolster block 40. Each buoyant cushion is formed by a pair of overlapping layers of buoyant material, preferably slabs of closed cell polyurethane foam F having a density in the range of 1–6 lbs./cu.ft. Each closed cell foam layer is in the form of a rectangular slab, having a typical thickness in the range of 1–2 inches, and is cut to form a lounge chair having an assembled height of 27 inches, a length of 30 inches and a width of 30 inches.

Referring again to FIG. 2, FIG. 3, FIG. 5, FIG. 6 and FIG. 13, overlapping pairs of buoyant cushions are attached and secured onto the chair frame members by an adhesive bonding agent, for example a deposit 42 of a fast setting contact cement, with the frame members being enclosed and sealed between the layers, thereby providing structural reinforcement for the soft, buoyant cushions. For this purpose, the chair seat 18 is formed by a pair of overlapping cushion layers 18A, 18B; the left chair arm is formed by a pair of overlapping arm support cushions 14A, 14B, with the left arm frame 34 being enclosed and sealed between the overlapping layers 14A, 14B.

Likewise, the right arm 16 is formed by a pair of overlapping cushion layers 16A, 16B that are adhesively bonded together with the right arm frame 36 being enclosed and sealed between the overlapping layers. The chair back 12 is also formed by overlapping cushion layers 12A, 12B which are adhesively bonded together, with the back frame 32 being enclosed and sealed between the overlapping cushion layers. The bolster block 40 is also formed by overlapping buoyant cushion layers 40A, 40B that are adhesively bonded together with the bolster frame 38 being enclosed and sealed between the overlapping cushion layers.

Figure 5:
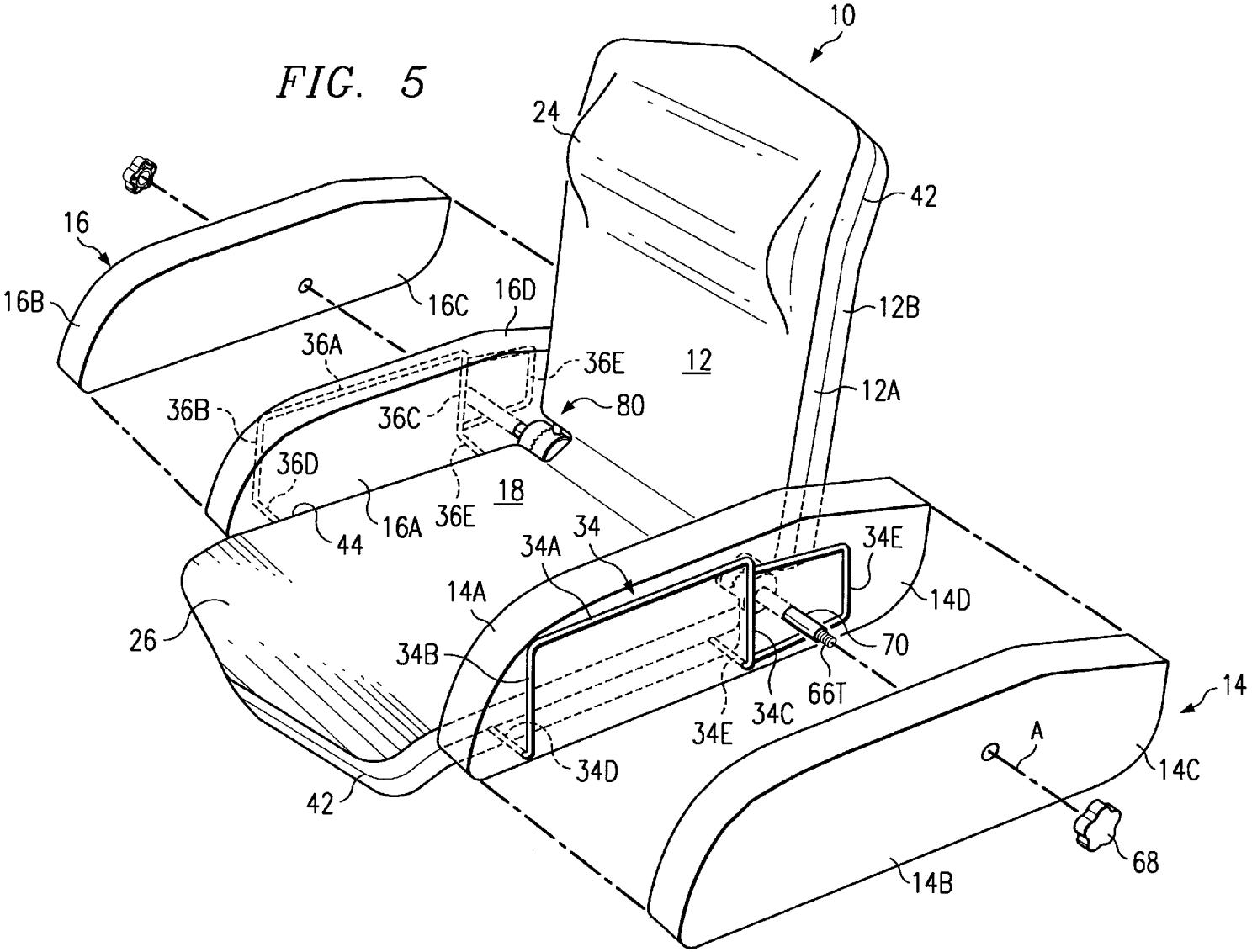
FIG. 5 is a perspective view similar to FIG. 3, showing the assembly of buoyant arm support cushions onto the left and right arm frames.
Figure 7:
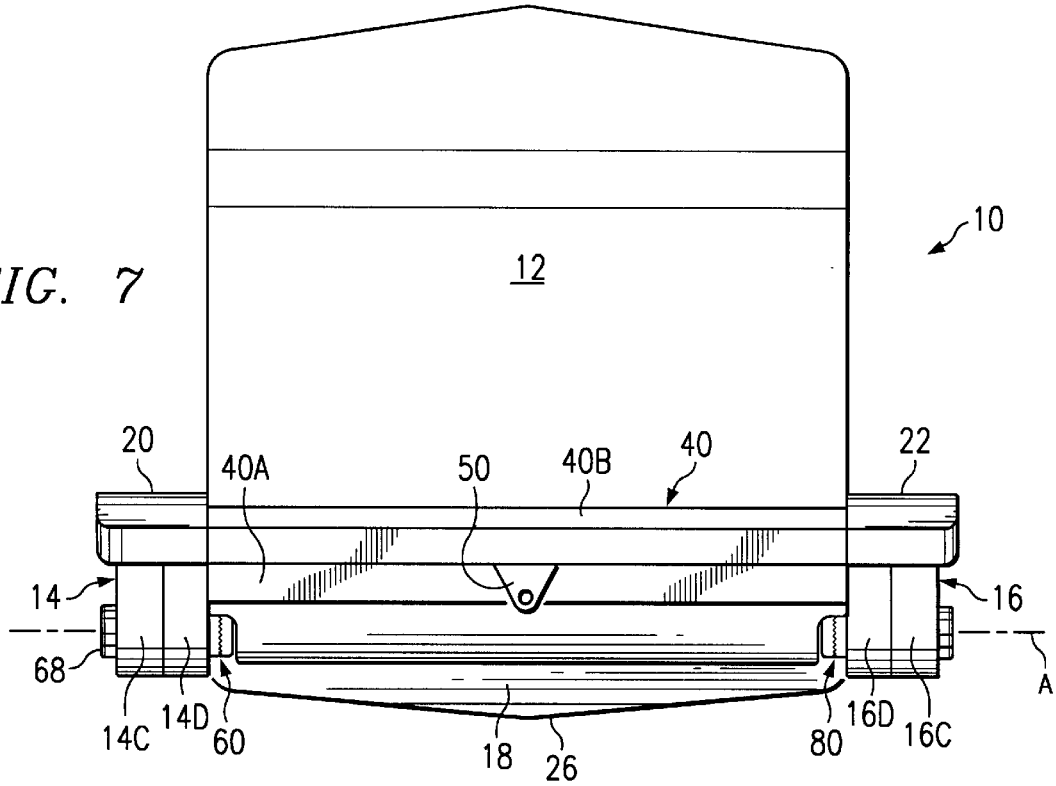
FIG. 7 is a rear elevational view of the buoyant lounge chair shown in FIG. 1.

Referring again to FIG. 1 and FIG. 5, the left and right chair arms 14, 16 are stabilized further by adhesive attachment to the left and right side edge portions of the chair seat 18. The chair arms overlap the laterally opposite sides of the chair back 12, but are not attached to it. The left and right arm support cushions are further stabilized by adhesive attachment to the left arm rest cushion 20 and right arm rest cushion 22 which bridge across the overlapping cushion layers 14A, 14B and 16A, 16B, respectively. As shown in FIGS. 5 and 7, aft projecting end portions 14C, 14D and 16C, 16D of the left arm support 14 and right arm support 16 overlap the opposite ends of the bolster block 40, which further improves the buoyancy and floating stability of the lounge chair.

The buoyant arm support sections 14, 16 are reinforced by the side arm frames 34, 36. The side arm frame 34 includes an upright arm support riser segment 34B that is laterally offset from the seat frame by an angled linking segment 34C. The side arm frame also includes a horizontal arm rest segment 34A that is vertically offset from the seat frame.

The right side arm frame is identically reinforced by a horizontal arm rest segment 36A, an upright arm support riser 36B and an angled linking segment 36C attached to the seat frame 30B. The left and right arm support cushions are thus stabilized and supported against collapse and separation from the chair frame by the rigid support provided by the left and right arm segments that are enclosed and sealed between the buoyant arm support cushions, as indicated in FIG. 13.

The aft projecting arm support cushions 14C, 14D and 16C, 16D are reinforced against deflection and separation from the chair frame by extension bars 34E, 36E, respectively. The extension bars 34E, 36E are welded onto the side arm frames 34, 36, respectively. The extension bars are laterally offset from the seat frame 30, and project aft of the pivotal union between the back frame 32 and the seat frame 30. The upright floating stability of the lounge chair is improved by the aft extending portions of the buoyant arm cushions which project aft of the pivotal union, whereby the aft projecting portions substantially overlap the laterally opposite end portions of the bolster block 40.

The upright floating stability of the lounge chair 10 is further improved by the seat frame assembly 30 which includes left and right seat frame segments 30A, 30B and a central seat frame segment 30C. The central seat frame segment 30C is connected on opposite ends to the seat frame side segments by angled connecting segments 30D, 30E. The seat frame segments are enclosed and sealed between the buoyant chair seat cushions 18A, 18B. The floating stability of the lounge chair is improved by the leg support section 26 that slopes downwardly from the chair seat 18, as shown in FIG. 1. The downward slope is provided by the angled seat frame segments 30D, 30E, as shown in FIG. 2.

Figure 6:
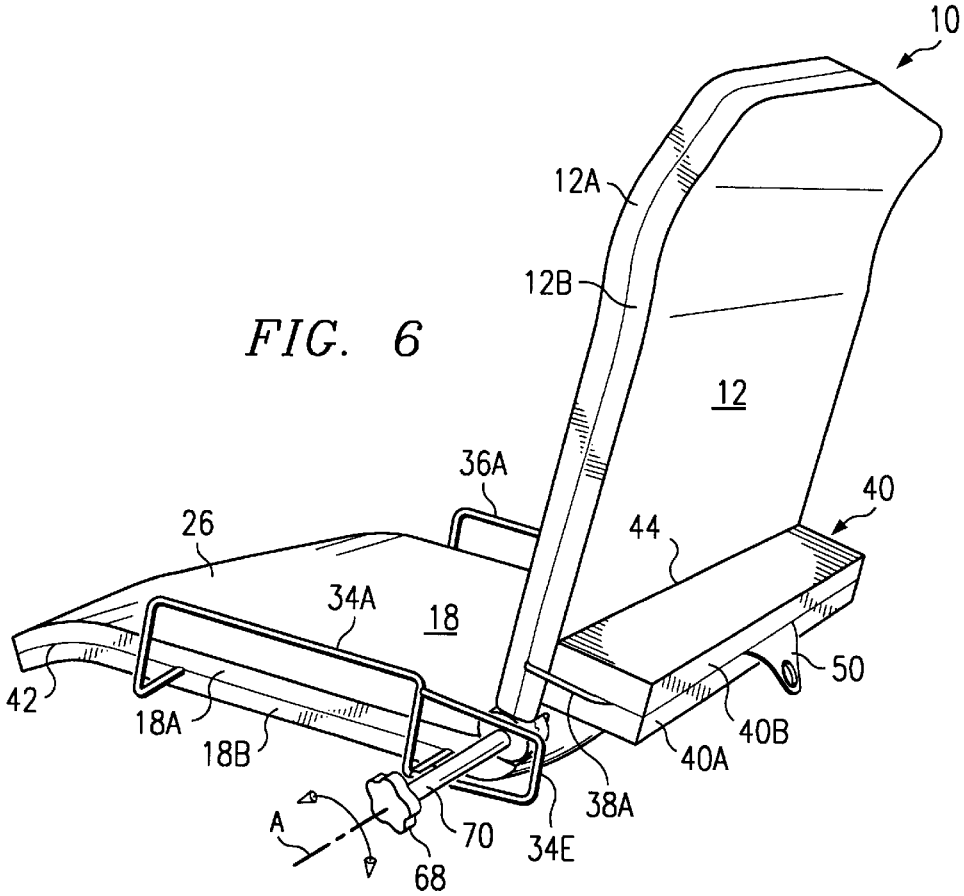
FIG. 6 is a rear perspective view of the buoyant lounge chair showing a bolster frame sandwiched between a pair of buoyant cushions.

The floating stability of the lounge chair is also improved by attaching the bolster block 40 onto the back frame 32 so that its moment arm spacing relative to the pivotal axis A remains constant as the chair back is adjusted throughout its angle of incline range. Referring to FIG. 2, FIG. 5 and FIG. 6, the bolster frame 38 includes left and right bolster frame segments 38A, 38B that project downwardly from the back frame 32, and are sandwiched between the lower and upper buoyant bolster cushions 40A, 40B. The bolster frame segments 38A, 38B maintain the bolster block 40 in a transverse verse orientation relative to the chair back 32 as the incline angle is adjusted from one position to another. Preferably, the bolster frame segments 38A, 38B slope transversely so that the bolster block 40 is inclined by about 20° relative to the horizontal arm support segments 34A, 36A when the lounge chair back is in the upright floating position.

Referring now to FIG. 1 and FIG. 13, the overlapping buoyant cushions are bonded and sealed together by a thin layer of adhesive 42. Additionally, the surface portions of the buoyant cushions bordering the lines of abutting engagement between the chair seat and the left and right chair arms, and between the chair back and the bolster block are further bonded together and sealed by a layer of flexible caulking material 44. Preferably, the caulking material is a high grade, 15–25 year acrylic material that provides good adhesion to the surface of the closed cell foam, and can withstand high shear forces arising along the interface surfaces. After the caulking material 44 has been applied and cured, a layer of solvent-based vinyl coating material 46 is applied to the exposed external surfaces of the lounge chair. Preferably, the protective vinyl coating 46 is applied over the external surfaces of the lounge chair 10 while it is suspended on a threaded weldment 48 from a hanger strap as described and claimed in our co-pending application Ser. No. 09/178,818 filed Oct. 26, 1998.

Figure 11:
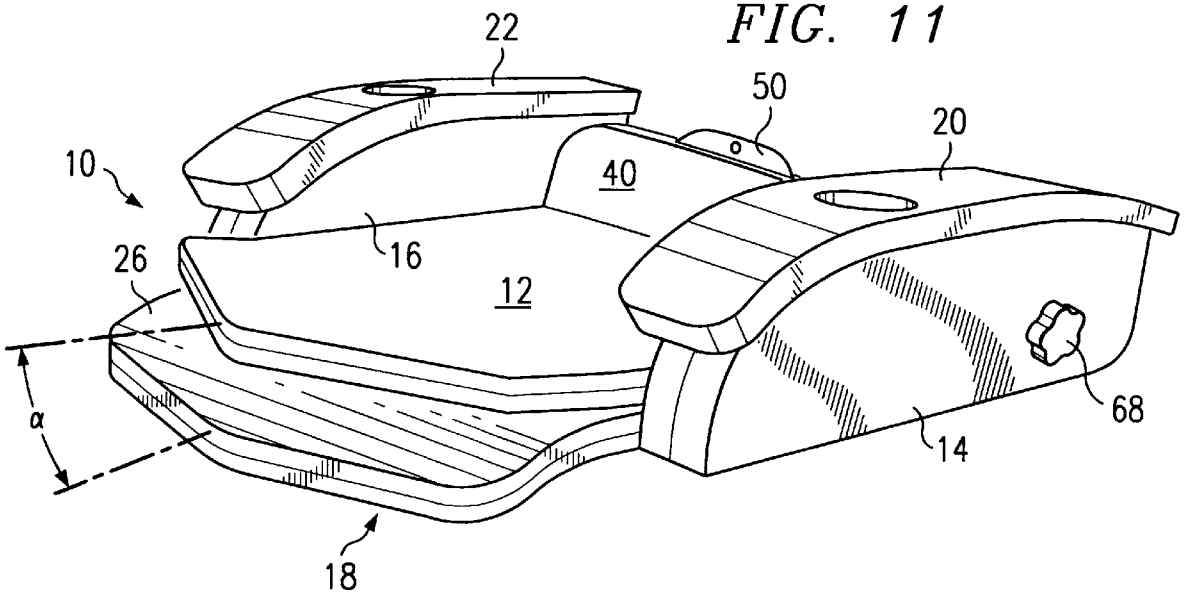
FIG. 11 is a perspective view of the buoyant lounge chair of FIG. 1 with the back folded forward in the minimum profile (storage/shipping) position.
Figure 15:
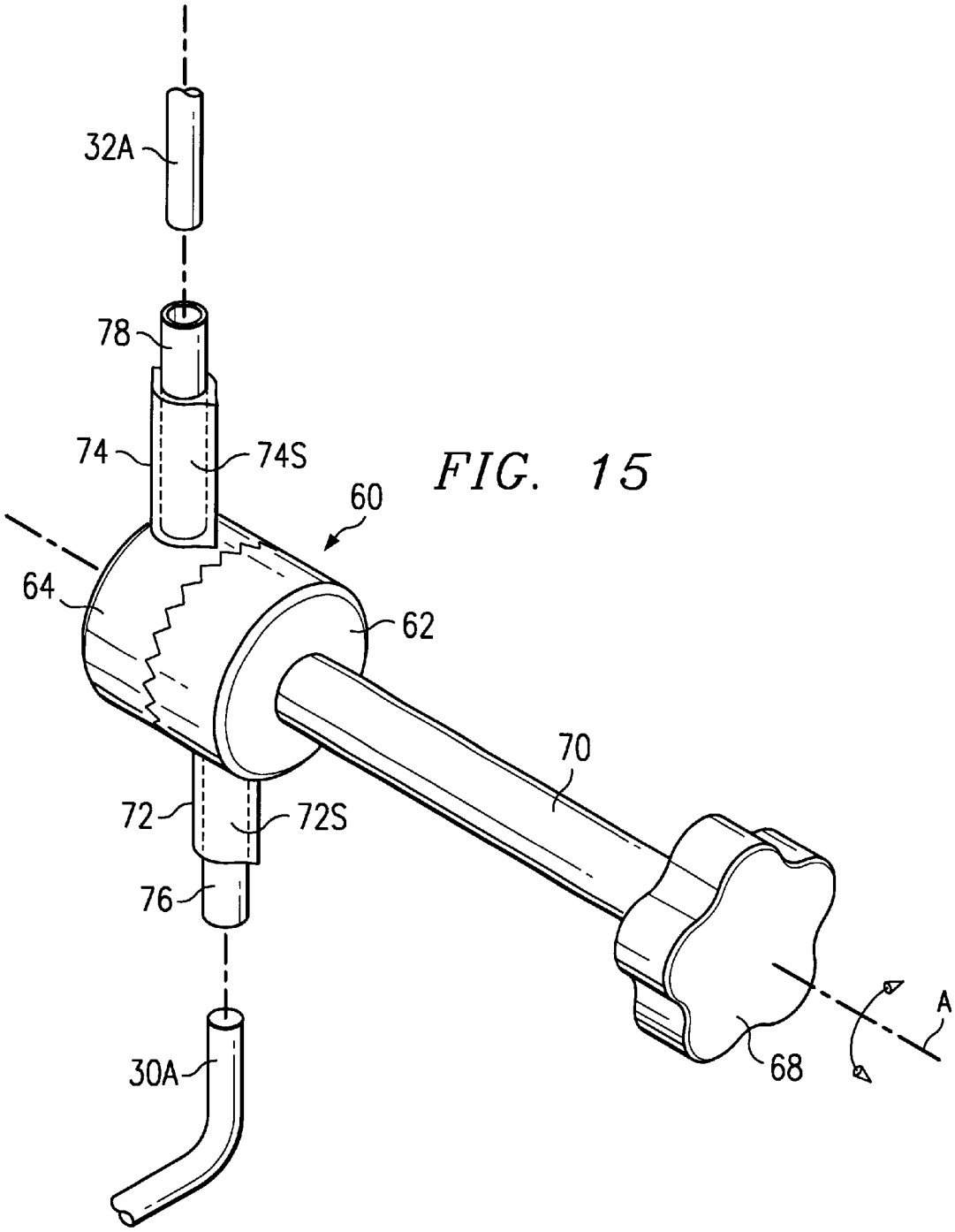
FIG. 15 is a perspective view, partially broken away, of an alternative embodiment of the pivotal coupling and clutch assembly.

Referring again to FIG. 1, FIG. 3 and FIG. 12, the buoyant cushions forming the chair seat 18 and the chair back 12 are preferably formed by first and second layers of buoyant cushion material 18A, 18B that are bonded together in overlapping relation by an adhesive deposit 42. According to this arrangement, the layers of buoyant cushion material forming the chair seat 18 and the chair back 12 are integrally formed together, with the seat frame 30 and the back frame 32 being captured and sandwiched between the overlapping layers. The top buoyant layer 18A forms a continuous body support surface that transitions smoothly through the incline angle . The incline angle can be varied through a range of from approximately 10° when the seat back is folded forward in the minimum profile position as shown in FIG. 11, to approximately 90° when the seat back 12 is in the upright position as shown in FIG. 1, and through approximately 180° when the seat back 12 is in the fully extended (body float) position as shown in FIG. 10.

Referring again to FIG. 6, FIG. 7 and FIG. 11, a flexible tie-off grommet 50 is attached to the bolster frame 38. The tie-off grommet 50 is enclosed and sealed between the lower and upper buoyant bolster layers 40A, 40B. An externally projecting portion of the tie-off grommet includes an eyelet for attachment to a tether line whereby the lounge chair 10 can be secured to a fixed structure such as a pool ladder so that the lounge chair will not be blown away during high winds. Also, the tie-off grommet can be used to hang the lounge chair from an overhead hook for inside sheltered storage, preferably with the lounge chair folded into its minimum profile configuration as shown in FIG. 11.

Figure 8:
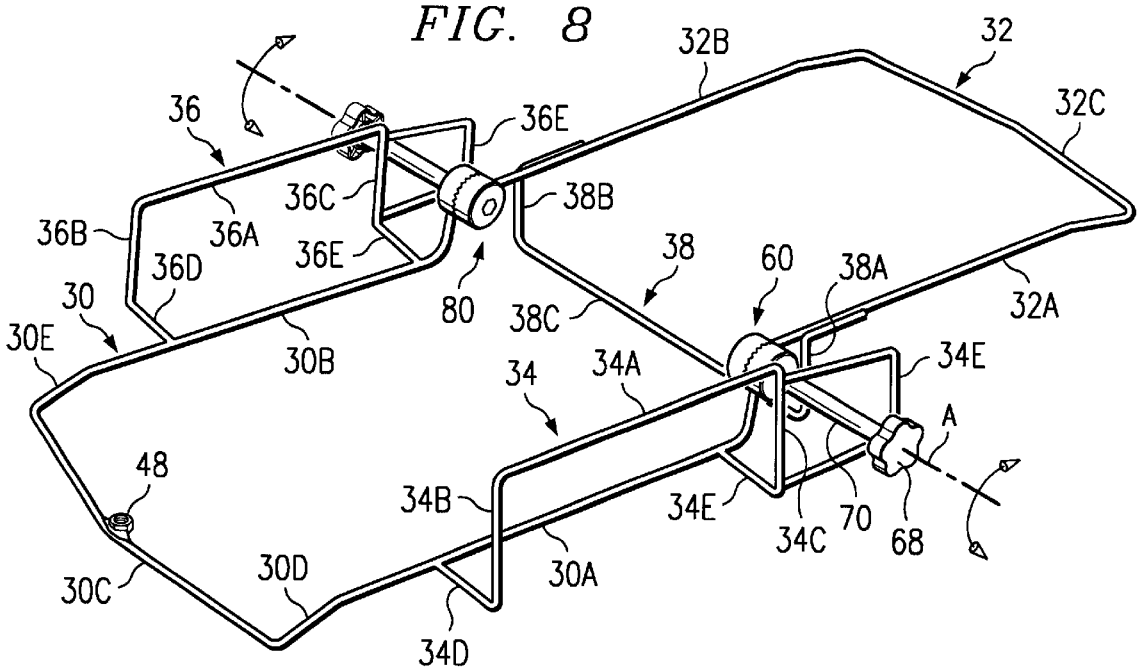
FIG. 8 is a perspective view of the open chair frame of FIG. 2 with the pivotal back frame in the extended, fully reclining (body float) position.
Figure 9:
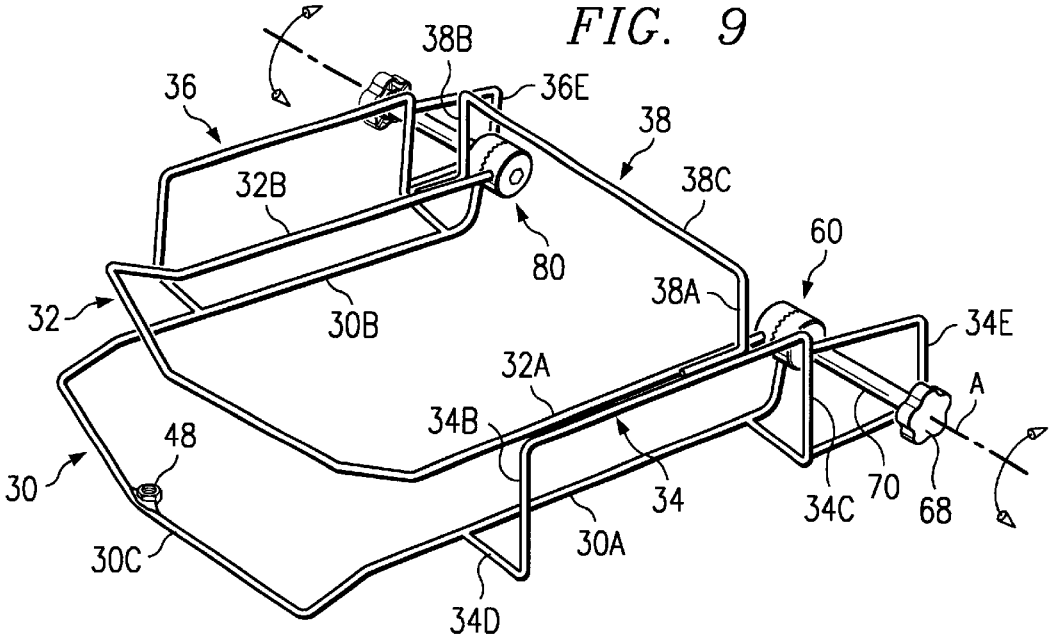
FIG. 9 is a perspective view of the open chair frame of FIG. 2, showing the back frame in the folded, minimum profile (storage/shipping) position.
Figure 16:
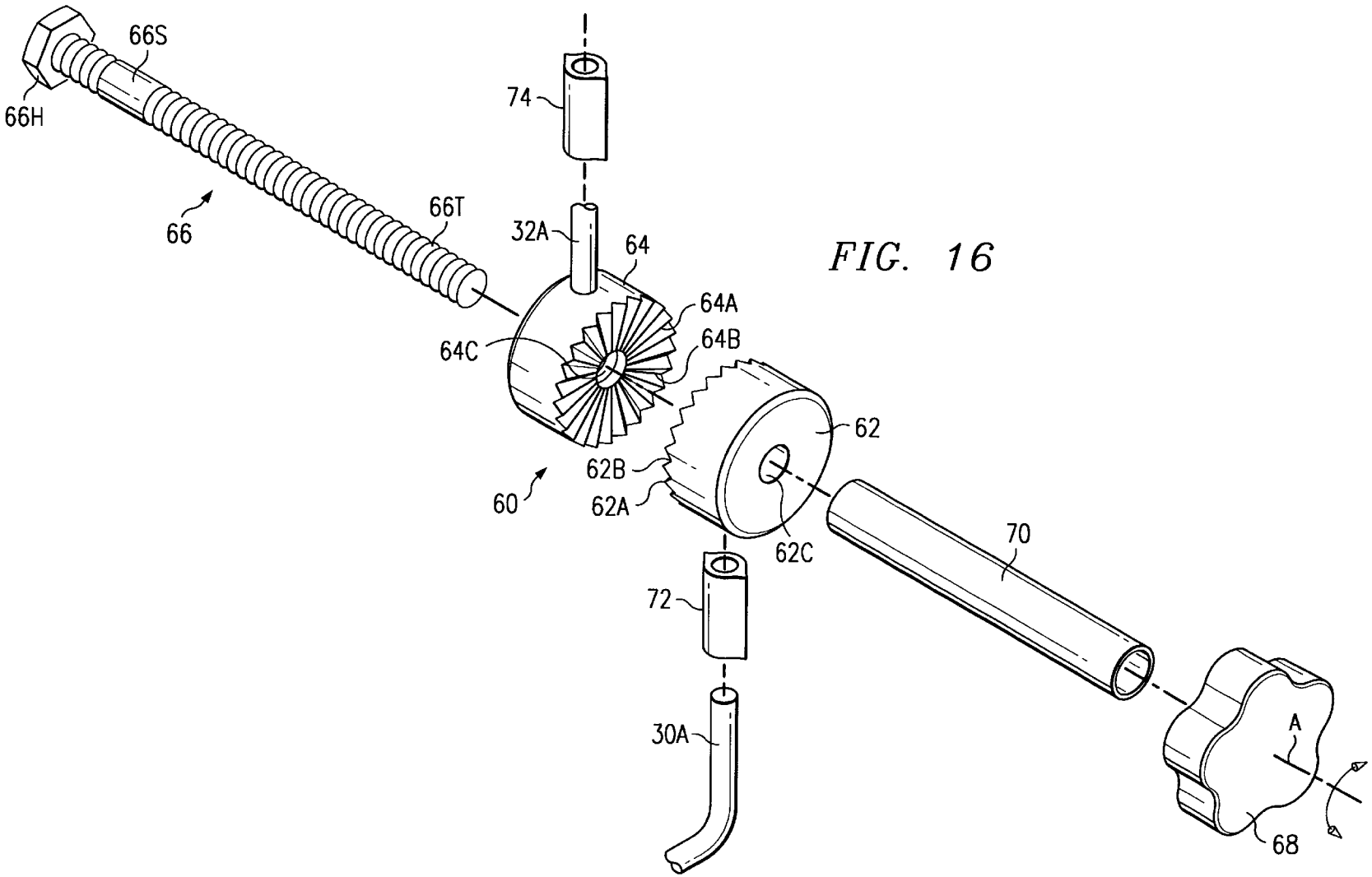
FIG. 16 is an exploded, perspective view of the pivotal coupling and clutch assembly of the present invention.

According to an important feature of the present invention, the back frame 32 is pivotally coupled to the seat frame 30 by a pair of clutch assemblies 60, 80 as shown in FIG. 2, FIG. 8 and FIG. 16. The construction of the clutch assembly 80 is identical to the clutch assembly 80. Referring in particular to FIG. 14 and FIG. 16, the clutch assembly 60 includes a fixed clutch member 62 attached to the seat frame 30A and a rotatable clutch member 64 attached to the back frame 32A. The fixed clutch member 62 and the rotatable clutch member 64 include complementary male and female end portions 62A, 62B and 64A, 64B that are adapted for mating engagement with each other when the clutch members are in the engaged position as shown in FIG. 14. Preferably, the male and female end portions consist of V-shaped ribs 62A, 64A and V-shaped pockets 62B, 64B that alternate with each other, wherein the V-shaped ribs on each clutch member are dimensioned and conformed for nesting engagement within the V-shaped pockets on the other clutch member.

Each clutch member is intersected by a coupling aperture 62C, 64C, respectively, which are in concentric alignment with each other when the clutch members are engaged as shown in FIG. 14. The fixed clutch member 62 and the rotatable clutch member 64 are mounted on a threaded axle shaft 66 which extends through the coupling apertures 62C, 64C. The rotatable clutch member is mounted for rotation on and axial movement along the axle shaft 66 from an engaged position, as shown in FIG. 14, in which the fixed clutch member and the movable clutch member are in contact with each other, to a disengaged position, as shown in FIG. 17, in which the fixed clutch member 62 and the rotatable clutch member 64 are separated from each other.

The angular position of the rotatable clutch member 64 relative to the fixed clutch member 62 is maintained by a manually operable actuator 68 and a compression tube 70.

Figures 17, 18:
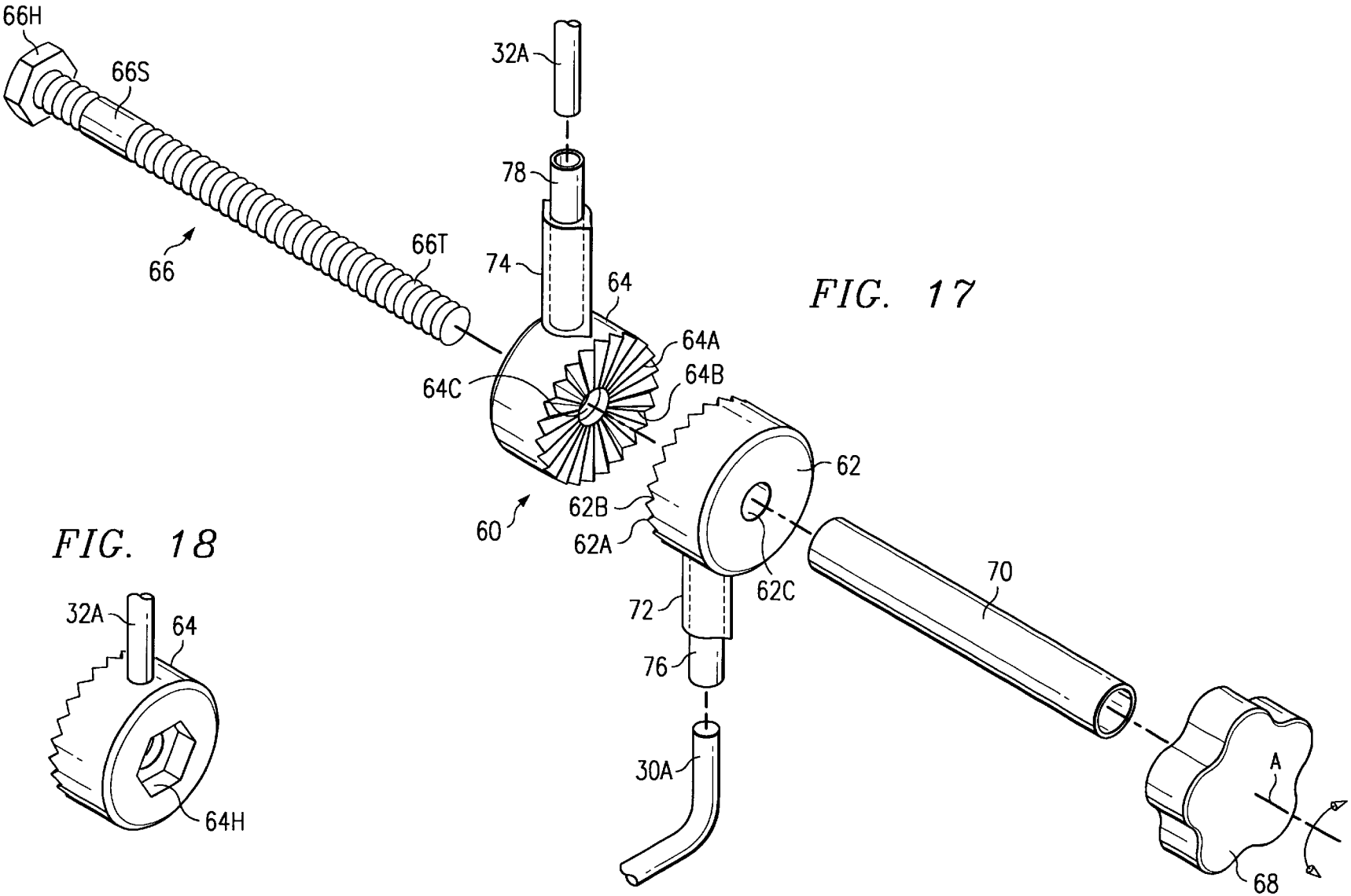
FIG. 17 is an exploded, perspective view similar to FIG. 16, illustrating an alternative embodiment of the pivotal coupling and clutch assembly.
FIG. 18 is a perspective view, partially broken away, of the inside coupling clutch member shown in FIG. 17.

Referring to FIG. 14, FIG. 17 and FIG. 18, the axle shaft 66 extends through the coupling apertures 62C, 64C of the fixed clutch member and rotatable clutch member, and also through the compression tube 70. The threaded end 66T of the axle shaft is engaged by a complementary threaded retainer 68R coaxially embedded, preferably by molding, within the actuator knob 68. As the actuator knob 68 is turned clockwise or counterclockwise, the actuator knob travels axially along the threaded end portion 66T against or away from the compression tube 70. The fixed clutch member 62 and the rotatable clutch member 64 are forced together in compressive engagement as the actuator knob 68 is rotated clockwise against the compression tube, and the clutch members 62, 64 are permitted to pull apart as the actuator knob 68 is rotated counterclockwise and travels away from the compression tube. Rotation of the axle shaft 66 is prevented by engagement of a hex head portion 66H within a complementary hex pocket 64H formed in the rotatable clutch member 64, as shown in FIG. 18. Preferably, the axle shaft 66 includes a smooth, cylindrical bearing surface 66S which is in registration with the coupling aperture 64C. This permits the rotatable clutch member 64 to ride on a smooth bearing surface during rotation of the back frame.

The length of the compression tube 70 and the length of the threaded portion 66T of the axle shaft 66 are selected appropriately so that the compression tube 70 extends through the side arm cushions 14A, 14B, with the threaded end portion 66T and the actuator knob 68 projecting externally of the side arm frame cushion 14B, as shown in FIG. 1 and FIG. 5. The actuator knob 68 is conveniently located so that the operator can manually release and set each clutch to permit pivotal movement of the back frame 32 relative to the seat frame 30, and to adjust and fix the angle of recline according to personal preference.

Referring to FIG. 1, FIG. 5 and FIG. 12, it will be appreciated that each clutch assembly 60, 80 is covered by the overlapping buoyant cushions that form the chair seat and the chair back. Preferably, the clutch members are constructed of a high strength, moldable plastic material such as polyvinyl chloride (PVC) or nylon which does not corrode when exposed to water. The frame rod segments, which are made of steel, should be sealed and protected from exposure to water to prevent rust. For this purpose, the seat frame segments 30A, 30B and the back frame segments 32A, 32B are adhesively sealed between the overlapping buoyant cushions 12A, 12B as shown in FIG. 13.

The water-tight seal is intensified and reinforced around the steel rod frame segments at the union with the clutch members by a first surface augmentation collar 72 and a second surface augmentation collar 74. The augmentation collars 72, 74 are formed as integrally molded parts of the clutch members 62, 64, and present enlarged side surfaces 72S, 74S, respectively, for adhesively bonding and forming a water-tight seal with the overlapping buoyant seat cushions 18A, 18B and overlapping buoyant back cushions 12A, 12B, as shown in FIG. 12 and FIG. 13.

Figure 19:
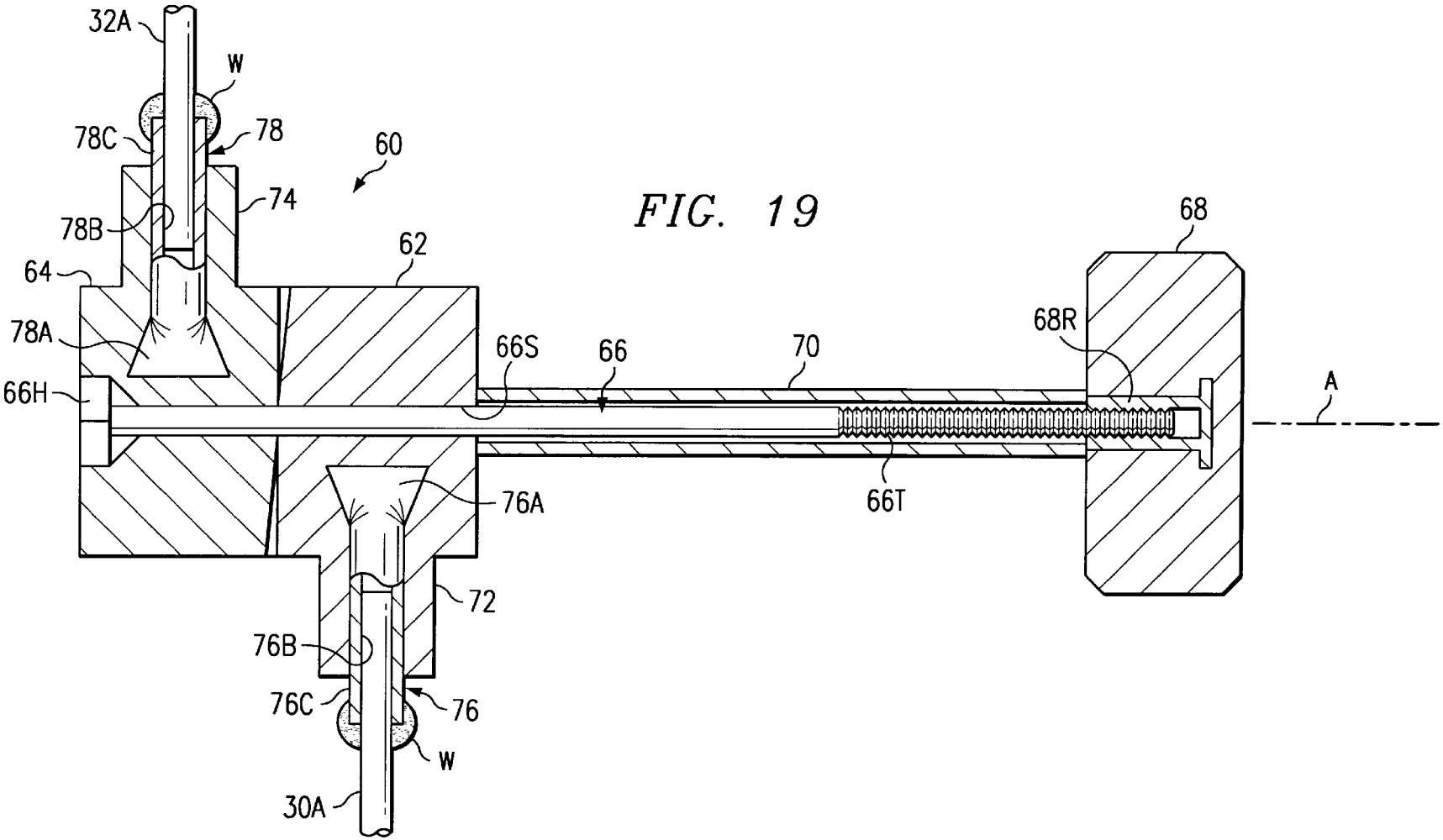
FIG. 19 is a sectional view of the pivotal coupling and clutch assembly shown in FIG. 17, with the clutch assembly in the engaged operative position.

Referring now to FIG. 13, FIG. 15, FIG. 16, FIG. 17 and FIG. 19, the union between each clutch member and the frame segment is reinforced by a tubular steel coupling sleeve 76 which is molded into and embedded within the fixed clutch member 62, and a tubular steel coupling sleeve 78 which is molded into and embedded within the body of the rotatable clutch member 64. According to this arrangement, the tubular coupling sleeves 76, 78 are preassembled and molded within the clutch members, and the surface augmentation collars 72, 74 are integrally molded around the tubular body portions 76C, 78C which project externally of the clutch members, as shown in FIG. 19.

During assembly, the steel rod seat frame segment 30A is inserted into the bore 76B of the tubular steel coupling sleeve 76, and is then welded to the tubular steel coupling sleeve. Likewise, the steel rod seat frame segment 32A is inserted into the bore 78B tubular steel coupling sleeve 78 and then is also welded to the tubular coupling sleeve. This arrangement facilitates assembly of the buoyant lounge chair, and provides a more reliable water-tight seal around the chair frame segments that are subject to corrosion. The weldment bead W between the chair frame segments and the tubular coupling sleeves, together with the embedded end portions 76A, 78A assure a permanent bond between the chair frame and each clutch member, and prevents separation of the back frame from the seat frame.

Figure 20:
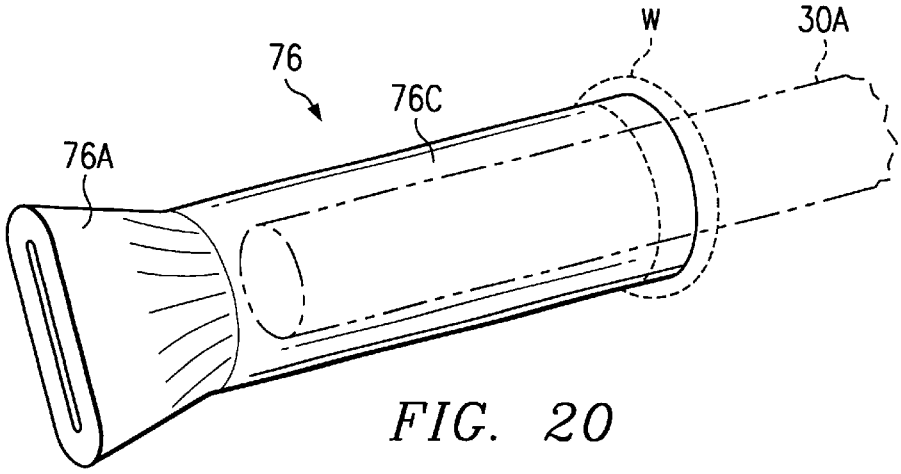
FIG. 20 is a perspective view of the tubular steel coupling sleeve shown in FIG. 19.
Figure 21:
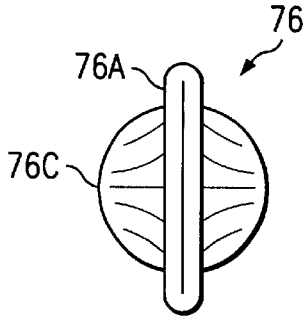
FIG. 21 is a left side elevational view thereof.
Figure 22:
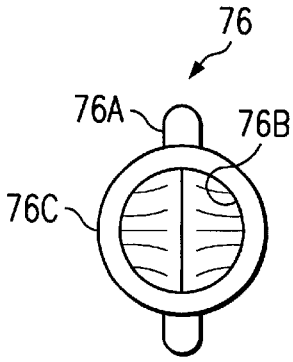
FIG. 22 is a right side elevational view thereof.

Referring now to FIG. 19, FIG. 20, FIG. 21 and FIG. 22, one end portion 76A of the tubular steel coupling sleeve 76 is flattened or crimped with a swage tool, as shown in FIG. 20, which causes the end portion to be radially enlarged and flare radially outwardly from the tubular sleeve body portion 76C. The radially enlarged end portion 76A is totally embedded and molded within the clutch body 62, thereby preventing twisting movement or axial movement of any kind of the tubular steel coupling sleeve with respect to the clutch body 62, thus firmly locking it into place. After the steel rod seat frame segment 30A is inserted into the cylindrical bore 76B of the steel coupling sleeve 76, as shown in FIG. 19, the two pieces are welded together by a weld bead W. The back frame segment 32A is secured in a welded union W with a tubular steel coupling sleeve 78 which is identically formed with a radially enlarged, flared end portion 78A. The result is a high strength union which can withstand rough handling without separation and is protected against corrosion.

Figure 23:
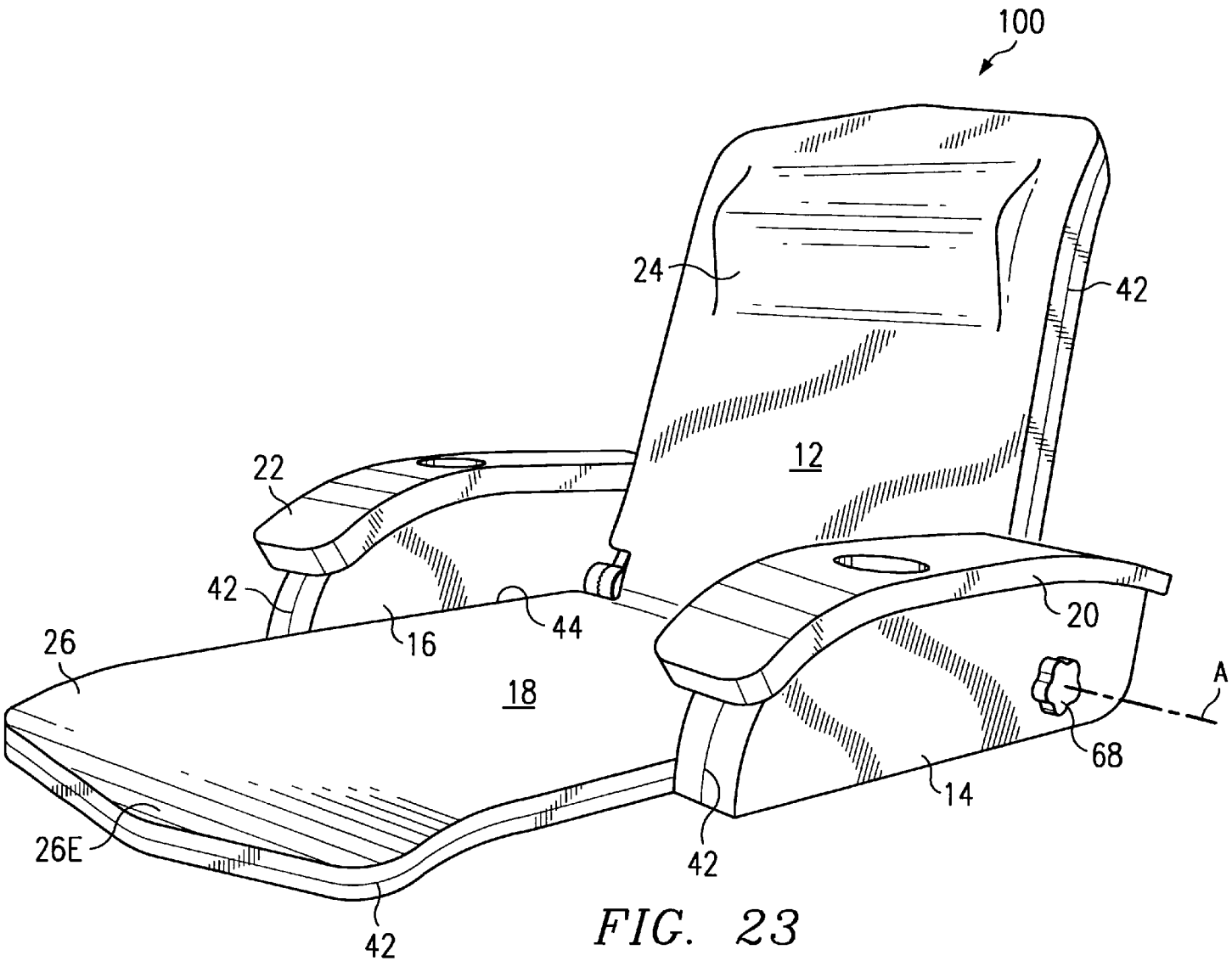
FIG. 23 is a perspective view of an alternative embodiment of the buoyant lounge chair of FIG. 1 which includes an extended leg support section.

Referring now to FIG. 23, an alternative lounge chair embodiment 100 includes an extended buoyant cushion portion 26E that projects forward of and in cantilevered relation to the central seat frame segment 30C. The extended length of the leg support section provides complete support for the swimmer's entire body, including his legs and feet, when the seat back 12 is set in the fully extended, body float position as shown in FIG. 10. The lounge chair 100 shown in FIG. 12 is identical in construction with the lounge chair 10 shown in FIG. 1, except for the additional leg support length.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A buoyant lounge chair for supporting a person in a seated or reclined lounging position while the chair is floating in water, comprising:

frame members collectively forming an open chair frame, the frame members including a seat frame and a back frame pivotally coupled to the seat frame;

buoyant cushions attached to the frame members, the buoyant cushions forming a chair seat and a chair back; and, a clutch assembly coupled to the seat frame and to the back frame, the clutch assembly including a manually operable actuator that is releasable to permit pivotal movement of the back frame relative to the seat frame, and engagable to fix the angle of recline of the back frame relative to the seat frame.

2. A buoyant lounge chair as set forth in claim 1, said actuator comprising:

an adjustment knob coupled to the clutch assembly, said adjustment knob being disposed externally of the chair frame for manually engaging and releasing the clutch assembly.

3. A buoyant lounge chair as set forth in claim 1, the clutch assembly comprising:

a fixed clutch member attached to the seat frame;

a movable clutch member attached to the back frame, the movable clutch member being movable from an engaged position in which the fixed clutch member and the movable clutch member are in contact with each other, to a disengaged position in which the fixed clutch member and the movable clutch member are separated from each other; and, the manually operable actuator being movable in a first direction for driving the movable clutch member into engagement with the fixed clutch member and movable in a second direction for releasing the movable clutch member to permit separation of the clutch members and rotation of the back frame relative to the seat frame.

4. A buoyant lounge chair as set forth in claim 1, the clutch assembly comprising:

an axle shaft;

a fixed clutch member mounted on the axle shaft and attached to the seat frame;

a movable clutch member attached to the back frame and mounted for movement along the axle shaft from an engaged position in which the fixed clutch member and the movable clutch member are in contact with each other, to a disengaged position in which the fixed clutch member and the movable clutch member are separated from each other; and, the manually operable actuator including a compression tube mounted on the axle shaft for movement in a first direction for driving the movable clutch member to the engaged position and movable in a second direction for releasing the movable clutch member to permit separation of the clutch members and rotation of the back frame relative to the seat frame.

5. A buoyant lounge chair as set forth in claim 4, wherein the fixed clutch member and movable clutch member include complementary male and female end portions, the male and female end portions being disposed in mating engagement with each other when the clutch members are in the engaged position.

6. A buoyant lounge chair as set forth in claim 4, wherein:

each clutch member is intersected by a coupling aperture, and th e axle shaft extends through the coupling apertures;

a compression tube is mounted on the axle shaft for axial movement toward and away from the movable clutch member; and, an actuator knob is coupled to the axle shaft for driving the compression tube along the axle shaft into engagement with the movable clutch member.

7. A buoyant lounge chair as set forth in claim 1, wherein the seat frame includes a seat frame segment and the back frame includes a back frame segment, and wherein the clutch assembly includes a fixed clutch member attached to the seat frame segment and a movable clutch member attached to the back frame segment, further comprising:

a first surface enlargement collar disposed adjacent the fixed clutch member, the seat frame segment being disposed within the first surface enlargement collar and sealed therein; and, a second surface enlargement collar disposed adjacent the movable clutch member, and the back frame segment being disposed within the second surface enlargement collar and sealed therein.

8. A buoyant lounge chair as set forth in claim 1, wherein the seat frame includes a seat frame segment and the back frame includes a back frame segment, and the clutch assembly includes a fixed clutch member coupled to the seat frame segment and a rotatable clutch member coupled to the back frame segment, further comprising:

a first coupling sleeve attached to the fixed clutch member, the first coupling sleeve having a cylindrical bore and the seat frame segment is disposed within the bore; and, a second coupling sleeve attached to the movable clutch member, the second coupling sleeve having a cylindrical bore and the back frame segment is disposed within the bore.

9. A buoyant lounge chair as set forth in claim 1, the buoyant cushions including:

a first pair of buoyant cushions attached to the chair frame, with the seat frame being enclosed between the buoyant cushions of the first pair; and, a second pair of buoyant cushions attached to the chair frame, with the back frame being enclosed between the buoyant cushions of the second pair.

10. A buoyant lounge chair as set forth in claim 1, further comprising:

a left arm frame including an arm support riser that is laterally offset from the seat frame and an arm rest segment that is vertically offset from the seat frame; and, a right arm frame including an arm support riser that is laterally offset from the seat frame and an arm rest segment that is vertically offset from the seat frame.

11. A buoyant lounge chair as set forth in claim 1, wherein:

the buoyant cushions forming the chair seat and the chair back comprising first and second layers of buoyant cushion material that are secured together in overlapping relation, with the seat frame and the back frame being enclosed between the first and second layers, and at least one of the layers forming a continuous body support surface that transitions through an angle from the chair back to the chair seat.

12. A buoyant lounge chair as set forth in claim 1, wherein:

the seat frame including left and right seat frame segments and a central seat frame segment connecting the left seat frame segment to the right seat frame segment, the left and right seat frame segments each including an angled connecting portion attached to the central seat frame segment, and the angled connecting portions sloping relative to the left and right seat frame segments, respectively, whereby the buoyant cushions in combination with the seat frame segments form a leg support section that slopes away from the chair seat when the lounge chair is in the floating position.

13. A buoyant lounge chair as set forth in claim 12, wherein:

the buoyant cushions forming the chair seat and the leg support section including first and second layers of buoyant cushion material that are secured together in overlapping relation with the left and right seat frame segments, the central seat frame segment and the angled connecting portions being enclosed between the first and second layers, and at least one of the layers forming a continuous body support surface that transitions through an angle from the chair seat to the leg support section.

14. A buoyant lounge chair as set forth in claim 1, wherein the seat frame including left and right seat frame segments and the back frame including left and right back frame segments that are pivotally coupled to the left and right seat frame segments, respectively, further comprising:

a bolster frame including left and right bolster frame segments attached to and projecting from the left and right back frame segments, respectively, and including a central bolster frame segment extending between the left and right bolster frame segments.

15. A buoyant lounge chair as set forth in claim 14, wherein the left and right bolster frame segments are inclined with respect to the back frame segments, further comprising:

first and second buoyant bolster cushions mounted on the bolster segments thereby defining a bolster block that slopes downwardly relative to the chair back when the lounge chair is in the upright floating position.

16. A buoyant lounge chair as set forth in claim 1, including:

a flexible tie-off grommet attached to the bolster frame and projecting externally of the central bolster frame segment.

17. A buoyant lounge chair as set forth in claim 1, wherein:

the seat frame including left and right seat frame segments and a central seat frame segment linking the left and right seat frame segments; and, the buoyant cushions forming the chair seat including first and second layers of buoyant cushion material that are secured together in overlapping relation, with the seat frame segments being enclosed between the first and second layers thereby forming a leg support section, the leg support section including an extended leg support section projecting forward of and in cantilevered relation to the central seat frame segment.

18. A buoyant lounge chair as set forth in claim 1, including:

a left arm frame attached to the seat frame;

a right arm frame attached to the seat frame; and, buoyant cushions attached to the arm frames thereby defining a left chair arm and a right chair arm.

19. A buoyant lounge chair as set forth in claim 18, including:

a left extension frame attached to the left arm frame and projecting aft of the chair seat;

a right extension frame attached to the right arm frame and projecting aft of the chair seat;

the buoyant cushions forming the left chair arm comprising a third pair of buoyant cushions that are secured together in overlapping relation, with the left arm frame and left extension frame being enclosed between said overlapping cushions; and, the buoyant cushions forming the right chair arm comprising a fourth pair of buoyant cushions that are secured together in overlapping relation, with the right arm frame and right extension frame being enclosed between said overlapping cushions.

20. A buoyant lounge chair as set forth in claim 18, including:

a left arm rest cushion mounted on the left chair arm, the left arm rest cushion including a portion extending aft of the clutch assembly; and, a right arm rest cushion mounted on the right chair arm, the right arm rest cushion including a portion extending aft of the clutch assembly.

21. A buoyant lounge chair as set forth in claim 1, including:

a left arm frame attached to the seat frame;

a right arm frame attached to the seat frame; and, buoyant cushions attached to the arm frames thereby defining a left chair arm and a right chair arm;

the left chair arm and the right chair arm being laterally spaced from each other on opposite sides of the chair seat, and the buoyant cushions forming the chair back are dimensioned to permit the chair back to be folded forward between the left chair arm and the right chair arm.

22. A buoyant lounge chair as set forth in claim 1, the clutch assembly comprising:

a fixed clutch member attached to the seat frame;

a movable clutch member attached to the back frame;

a first coupling sleeve attached to the fixed clutch member, the first coupling sleeve including a tubular body portion and a retainer end portion, the retainer end portion being embedded within the fixed clutch member and the tubular body portion projecting externally of the fixed clutch member, the tubular body portion having a bore and a portion of the seat frame is disposed within the bore; and, a second coupling sleeve attached to the movable clutch member, the second coupling sleeve including a tubular body portion and a retainer end portion, the retainer end portion being embedded within the movable clutch member and the tubular body portion projecting externally of the movable clutch member, the tubular body portion having a bore and a portion of the back frame is disposed within the bore.

23. A buoyant lounge chair as set forth in claim 22, wherein:

the seat frame is rigidly connected to the tubular body portion of the first coupling sleeve by a first weld; and, the back frame is rigidly connected to the tubular body portion of the second coupling sleeve by a second weld.

24. A buoyant lounge chair for supporting a person in a seated position or in a reclining position while the chair is floating in water, comprising:

frame members collectively forming an open chair frame, the frame members including a seat frame, a back frame pivotally coupled to the seat frame, a left arm frame and a right arm frame;

the seat frame including a left frame segment and a right frame segment that are laterally spaced apart;

the back frame including a left frame segment and a right frame segment that are laterally spaced apart;

a first clutch assembly releasably connecting the left seat frame segment to the left back frame segment;

a second clutch assembly releasably connecting the right seat frame segment to the right back frame segment; and, buoyant cushions attached to the frame members, the buoyant cushions forming a chair seat, a chair back, a left chair arm and a right chair arm.

25. A buoyant lounge chair as set forth in claim 24, each clutch assembly comprising:

a fixed clutch member attached to the seat frame;

a movable clutch member attached to the back frame, the movable clutch member being movable from an engaged position in which the fixed clutch member and the movable clutch member are in contact with each other, to a disengaged position in which the fixed clutch member and movable clutch member are separated from each other; and, a manually operable actuator coupled to the movable clutch member for driving the movable clutch member into engagement with the fixed clutch member and for releasing the movable clutch member to permit separation of the clutch members and rotation of the back frame relative to the seat frame.

26. A buoyant lounge chair as set forth in claim 24, each clutch assembly comprising:

an axle shaft;

a fixed clutch member mounted on the axle shaft and attached to the seat frame;

a movable clutch member attached to the back frame and mounted for movement on the axle shaft from an engaged position in which the fixed clutch member and movable clutch member are in contact with each other to a disengaged position in which the fixed clutch member and movable clutch member are separated from each other; and, a manually operable actuator coupled to the movable clutch member for driving the movable clutch member to the engaged position and for releasing the movable clutch member to permit separation of the clutch members and rotation of the back frame relative to the seat frame.

27. A buoyant lounge chair as set forth in claim 24, each clutch assembly including a manually operable actuator that is releasable to permit pivotal movement of the back frame relative to the seat frame, and engagable to fix the angle of recline of the back frame relative to the seat frame; and, each actuator including an adjustment knob rotatably coupled to the clutch assembly, said adjustment knob being disposed externally of the left chair arm and the right chair arm, respectively.

28. A buoyant lounge chair as set forth in claim 24, wherein the left chair arm and the right chair arm are laterally spaced from each other on opposite sides of the chair seat, and the buoyant cushions forming the chair back are dimensioned to permit the chair back to be folded forward between the left chair arm and the right chair arm.

29. A buoyant lounge chair as set forth in claim 24, wherein each clutch assembly includes a fixed clutch member coupled to one of the seat frame segments and a rotatable clutch member coupled to one of the back frame segments, further comprising:

a first coupling sleeve attached to the fixed clutch member, the first coupling sleeve including a tubular body portion and a retainer end portion, the retainer end portion being embedded within the fixed clutch member and the tubular body portion projecting externally of the fixed clutch member, the tubular body portion having a bore and the seat frame segment is disposed within the bore; and, a second coupling sleeve attached to the movable clutch member, the second coupling sleeve including a tubular body portion and a retainer end portion, the retainer end portion being embedded within the movable clutch member and the tubular body portion projecting externally of the movable clutch member, the tubular body portion having a bore and the back frame segment is disposed within the bore.

30. A buoyant lounge chair as set forth in claim 29, wherein:

the seat frame segment is rigidly connected to the tubular body portion of the first coupling sleeve by a first weld; and, the back frame segment is rigidly connected to the tubular body portion of the second coupling sleeve by a second weld.

* * * * *